US006124796A

United States Patent [19]

Hincher

[11] Patent Number: 6,124,796

[45] Date of Patent: Sep. 26, 2000

[54] FIRE EQUIPMENT BRACKET HAVING INTEGRAL LOCATING BEACON

[76] Inventor: William Hincher, 23 Pittenger Pond Rd., Freehold, N.J. 07728

[ * ] Notice: This patent is subject to a terminal disclaimer.

[21] Appl. No.: 09/372,084

[22] Filed: Aug. 11, 1999

[51] Int. Cl.[7] ..... G08B 17/10

[52] U.S. Cl. ..... 340/628; 340/326; 340/691; 340/693; 340/321; 340/332; 328/2

[58] Field of Search ..... 340/628, 326, 340/691, 693, 321, 332; 320/2

[56] References Cited

U.S. PATENT DOCUMENTS

| | | | |
|---|---|---|---|
| D. 244,392 | 5/1977 | Montambo | D29/2 |
| D. 266,061 | 9/1982 | Wanzlaff | D10/114 |
| 4,015,250 | 3/1977 | Fudge | 340/280 |
| 4,360,802 | 11/1982 | Pinto | 340/568 |
| 4,548,274 | 10/1985 | Simpson | 169/51 |
| 4,787,460 | 11/1988 | Clarkson | 169/51 |
| 4,916,438 | 4/1990 | Collins et al. | 340/636 |
| 5,153,567 | 10/1992 | Chimento | 340/691 |
| 5,408,771 | 4/1995 | Manrubia | 40/152.2 |
| 5,412,887 | 5/1995 | Layne | 40/152.2 |
| 5,446,439 | 8/1995 | Kramer et al. | 340/326 |
| 5,515,036 | 5/1996 | Waraksa et al. | 340/825.72 |
| 5,638,906 | 6/1997 | McCabe | 169/51 |
| 5,793,280 | 8/1998 | Hincher | 340/326 |
| 5,952,919 | 9/1999 | Merill | 340/539 |

*Primary Examiner*—Daniel J. Wu
*Assistant Examiner*—Tai T. Nguyen
*Attorney, Agent, or Firm*—Siemens Patent Service, LC

[57] ABSTRACT

A fire extinguisher bracket having a beacon for rendering the fire extinguisher conspicuous even in a darkened location. The bracket has structure for engaging the fire extinguisher and structure for mounting the bracket to an environmental surface. The beacon may be audible or visible or both, and may be arranged for constant or intermittent operation. A battery carried by the bracket powers the beacon. A battery charger assures that the battery is always charged. An automatic switch operates the beacon subject to a specified condition, such as detection of motion, thereby assuring likelihood of human presence, and detection of placement of a fire extinguisher within the bracket. Switches may be arranged for selective manual and automatic operation of the beacon. The bracket includes a smoke detector arranged to activate the beacon. A timer controls when the beacon is activated. The bracket has straps for holding safety related articles thereto. Data corresponding to identifying or advisory is provided in the form of raised or cut out lettering, which may be discerned by touch.

14 Claims, 5 Drawing Sheets

FIRE EQUIPMENT BRACKET HAVING INTEGRAL LOCATING BEACON

REFERENCE TO RELATED APPLICATION

This application is related to my prior U.S. Pat. No. 5,793,280, issued Aug. 11, 1998.

BACKGROUND OF THE INVENTION

1. Field of the Invention

The present invention relates to improvements to brackets for holding fire extinguishers and the like. The improvements include incorporation of a signaling beacon, straps for holding separate, removable safety related objects, integral smoke detector, and operably interlocking with building emergency systems, such as smoke detectors. The beacon visually or audibly indicates location of the bracket. A particularly critical application of the invention is to signal the location of a fire extinguisher and other safety equipment in a room or corridor of a building which has been darkened by intentional or damage responsive interruption of lighting.

2. Description of the Prior Art

Certain objects are intended for emergency use, and locating the same during an emergency is of the essence. An example is a fire extinguisher. Fire extinguishers are generally mounted to environmental surfaces, such as building walls or walls of a motor vehicle. In the event of a fire or similar emergency situation calling for utilization of the fire extinguisher, the mere act of locating the fire extinguisher may present a problem. It may be that in the event of a fire, smoke obscures the location of the fire extinguisher. Alternatively, lighting within a building or motor vehicle may be interrupted either intentionally to mitigate propensity for damage or in response to damage which has already occurred.

Any of these situations may render a fire extinguisher difficult to locate in the moment of need. Yet at this time, it is most critical that the fire extinguisher be conspicuous. There remains a need for ability of a fire extinguisher to remain conspicuous in conditions of poor illumination within a structure.

U.S. Pat. No. 4,787,460, issued to Joseph G. Clarkson on Nov. 29, 1988, further describes the problem and proposes a visual solution for the problem. The solution proposed by Clarkson takes the form of a covering or mounting plate for a fire extinguisher mounted in a building which is brightly marked in distinctive patterns for making the mounting of the fire extinguish conspicuous. However, under conditions wherein ambient illumination is very weak or absent, even the bright and distinctive markings of Clarkson are susceptible to being rendered ineffectively conspicuous. By contrast, the present invention provides a self-illuminated bracket, which generates its own illumination, thereby overcoming inadequate ambient lighting.

A bracket for a fire extinguisher is shown in U.S. Design Pat. No. 244,392, issued to Roger Jay Montambo on May 17, 1977. This device is representative of fire extinguisher brackets generally, showing critical characteristics thereof, and lacks lighting of any type.

A bracket having an associated light is shown in U.S. Design Pat. No. 266,061, issued to Karl H. Wenzlaff on Sep. 7, 1982. However, unlike the present invention, Wenzlaff's bracket is intended to support the light and not a second object, such as a fire extinguisher.

U.S. Pat. Nos. 5,408,771, issued to Bob Manrubia on Apr. 25, 1995, and 5,412,887, issued to James R. Layne on May 9, 1995, describe, respectively, an illuminated box frame and an illuminated cabinet. In both cases, the subject invention nearly fully envelopes the enclosed object. By contrast, the present invention is a bracket having a limited number of bands engaging the enclosed object along a limited area of its outer surface. This characteristic exposes a significant portion of the supported object, which has the effect of suggesting or revealing how to disengage the object from its support. This is important in the case of fire extinguishers, which may well be required to be deployed expeditiously when their necessity arises.

U.S. Pat. No. 5,153,567, issued on Oct. 6, 1992 to Samuel V. Chimento, describes an alarm kit comprising a mounting plate having audible and visual alarms and structure for holding a fire extinguisher and a flashlight. However, the alarm kit of Chimento lacks the electrical controls of the present invention.

U.S. Pat. No. 4,015,250, issued to William L. Fudge on Mar. 29, 1977, describes a fire extinguisher cabinet having an alarm activated by removal of the fire extinguisher. Operation of the alarm of Fudge is opposite that of the present invention, wherein in the latter, placing the fire extinguisher in its holder activates the electrical system. In other differences compared to the present invention, Fudge provides an enclosed cabinet rather than an open bracket, and lacks the electrical control features of the present invention.

U.S. Pat. No. 5,515,036, issued to Thomas J. Waraksa et al. on May 7, 1996, describes a keyless entry system for an automotive vehicle. This system lacks the bracket, equipment holders, and electrical battery and control features of the present invention.

None of the above inventions and patents, taken either singly or in combination, is seen to describe the instant invention as claimed.

SUMMARY OF THE INVENTION

The present invention combines a suitable, conventional mounting for a fire extinguisher with a self-contained beacon for rendering the fire extinguisher conspicuous. The beacon may be audible, visual, or both. The mounting for the fire extinguisher has structure for engaging the fire extinguisher and structure for mounting the bracket to an environmental surface.

Preferably, the bracket incorporates conventional structural features for engaging the fire extinguisher, such as a band for encircling a cylindrical fire extinguisher. Structure for mounting the bracket to an environmental surface may include a plate having holes for receiving fasteners, for wall mounting. Recessed mounting may be accommodated by providing a frame suitable for mounting in a recess in a wall. Still other mounting structure is possible, such as a floor stand.

The beacon is either hard wired to a building electrical system, or alternatively is provided with independent power, such as batteries carried on board the novel bracket. In the latter case, the batteries are supplied from a battery charger connected to the building electrical system, so that power is available even if the building electrical supply is interrupted. This renders illumination independent of any power connection to a building, which power connection is susceptible to interruption during a fire. Controls are optionally provided for de-energizing or otherwise regulating the beacon. The beacon may be turned on, turned off, and connected to a secondary controller which responds to certain conditions.

An example of the latter is a proximity detector, which links beacon operation to inference of human activity. Since most human activities involve motion, the beacon could be operative only when human presence is inferred, so as to conserve battery power and avoid interruption of operation for service. A second example is a proximity switch energizing the beacon when the fire extinguisher is supported by the bracket. This feature avoids battery depletion when the fire extinguisher is removed for use, service, transport, or instruction of personnel. A third example is a smoke detector, which may be either integral with the bracket or alternatively may be remotely located therefrom. The bracket is provided with a relay operably connected to the smoke detector. If a fire condition is sensed, the relay energizes the beacon and optionally, a central building sprinkler system. The bracket further includes mounting straps for removably holding safety related articles such as a flashlight, safety cutting equipment for freeing a person trapped following an accident, and a first aid kit.

The bracket includes tactile readable indicia advising the nature of the bracket, or identifying articles held on the bracket. The indicia may be raised from or embossed on the bracket surface, or may be cut out therefrom, so that a person can identify the legend by touch.

The bracket preferably includes a timer which activates the powered features at predetermined times of day. These times may coincide, for example with business hours or with times at which the facility being protected is expected to be occupied.

Accordingly, it is one object of the invention to provide a bracket for supporting a fire extinguisher, the bracket having a beacon for rendering the fire extinguisher conspicuous.

It is another object of the invention to provide power for the beacon which renders the novel bracket independent of connection to power from an external structure.

It is a further object of the invention to provide a self-illuminating visual beacon.

Still another object of the invention is to provide an audible beacon.

An additional object of the invention is to provide controls for de-energizing the beacon when desired.

Yet a further object of the invention is to provide a reliable supply of electrical power which is not dependent upon operability of general power circuits of a building.

Yet another object of the invention is to link beacon operation to inference that human activity is present.

Still another object of the invention is to interlock the beacon with a smoke detector.

A further object of the invention is to hold safety related articles on the bracket.

An additional object of the invention is to provide identifying indicia on the bracket which can be sensed by touch, and does not require visibility for reading.

Yet another object of the invention is to provide a timer which activates powered features of the bracket at predetermined times of day.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
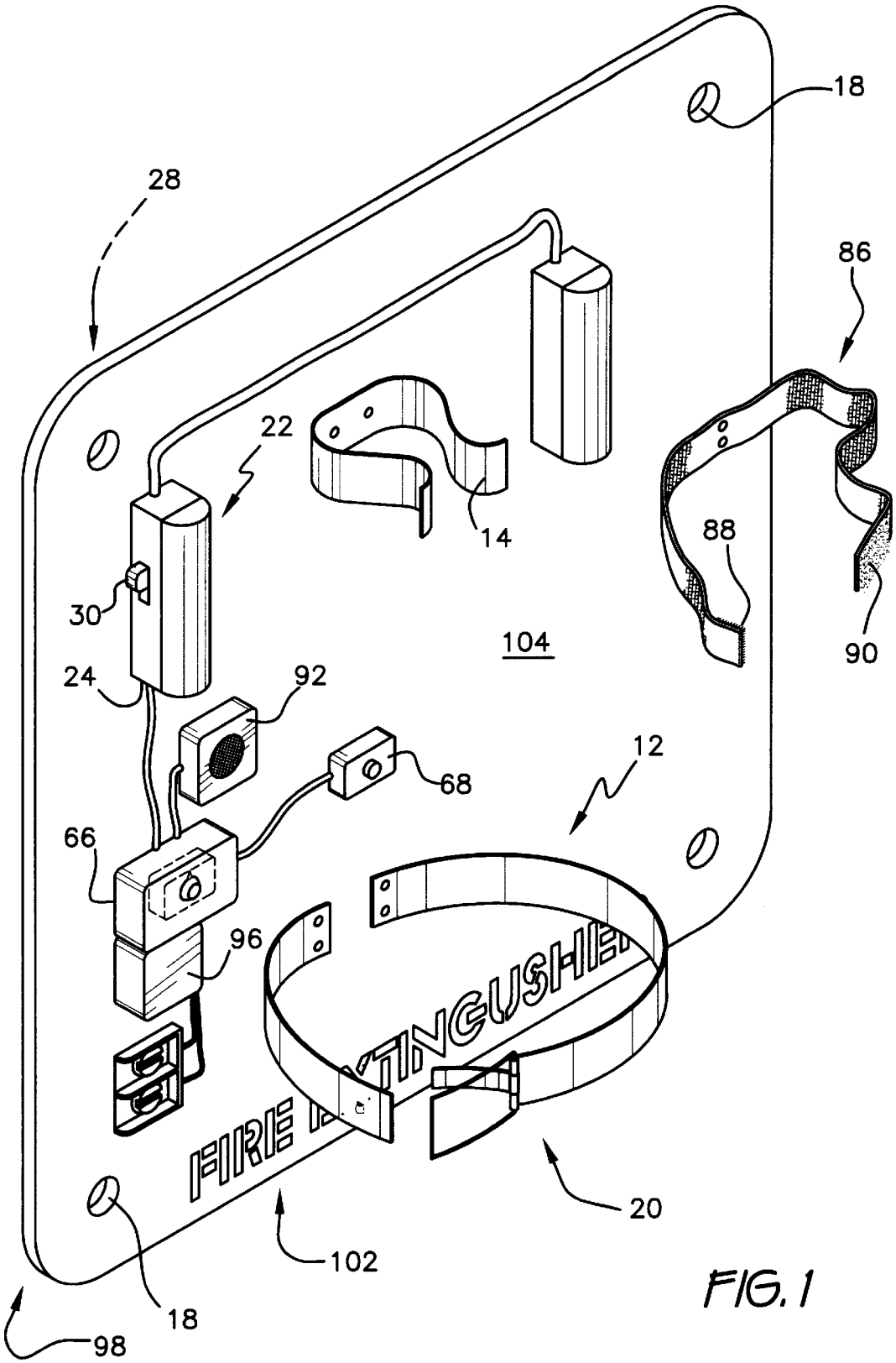
FIG. 1 is a front perspective view of a first embodiment of the invention.

Turning now to FIG. 1 of the drawings, bracket 10 is seen to comprise a band 12 and a clip 14 fixed to a base plate 16. Base plate 16 has holes 18 for accepting fasteners (not shown) enabling bracket 10 to be mounted to a vertical environmental surface. Band 12 encircles and thus partially surrounds an elongated object (not shown) which is to be supported by bracket 10. Band 12 has a suitable latch 20 for securing the supported object to bracket 10.

Components described thus far are generally conventional. Bracket 10 is distinguished from prior art brackets by provision of two visible beacons in the form of lighting fixtures 22. Each lighting fixture 22 has a lens 24, a battery 28, and a switch 30. Each lighting fixture is thus self-contained, and independent of connection to external power.

The two lighting fixtures 22 are provided so that when a fire extinguisher or other elongated object is secured to bracket 10, light emanating from one lighting fixture 22 will be visible from every viewing direction. That is, the fire extinguisher will not conceal all light, as might occur if only one lighting fixture 22 were provided.

Bracket 10 includes second support apparatus, such as a strap 86 having hook and loop fastening elements 88, 90 (respectively). Second support apparatus is of dimensions and configuration different from those of the first support apparatus, which first support apparatus supports a fire extinguisher. Strap 86 is disposed to at least partially encircle and thereby support a fire safety related article (not shown) on bracket 10. Examples of articles which may be attached to bracket 10 include, but of course are not limited to, a flashlight, an emergency cutting tool, and a first aid kit.

Identifying or advisory indicia, such as legend 102, is provided on bracket 10 in a form recognizable by touch. For example, lettering of the legend is embossed or raised from the exposed surface 104 of base plate 16. Alternatively, legend 102 may be formed from voids formed by cutting material out of base plate 16.

Figure 2:
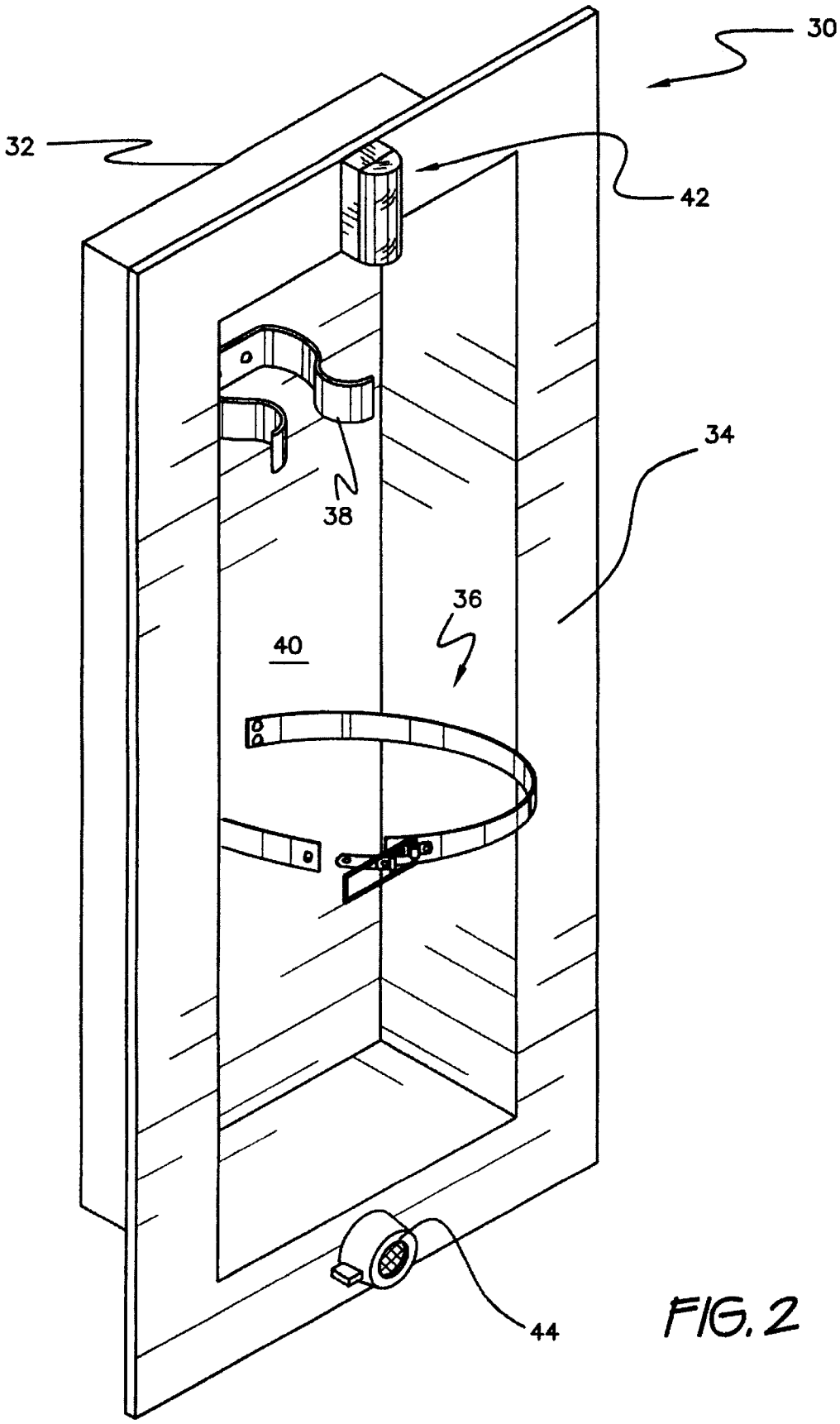
FIG. 2 is a perspective view of a second embodiment of the invention.

The embodiment of FIG. 1 is intended for mounting on a wall of a room or corridor of a building or a mobile structure, such as a motor vehicle. A second embodiment is shown in FIG. 2. Bracket 30 is intended for flush mounting in a wall or other vertical environmental surface. To this end, bracket 30 has a recessed cabinet 32 and a trim flange or plaster ring 34. Cabinet 32 is intended to occupy a cavity formed in the wall, and is inserted into the cavity during installation until plaster ring 34 abuts the wall.

Cabinet 32 is preferably of a depth sufficient so that a fire extinguisher may be housed therein and not project forwardly of plaster ring 34. Optionally, a door (not shown) or other closure may be hinged to or otherwise fastened to cabinet 32.

Bracket 30 has a band 36 and a clip 38 mounted on the rear wall 40 of bracket 30. Band 36 and clip 38 are essentially similar to those of the embodiment of FIG. 1. Because bracket 30 is flush mounted, the fire extinguisher will not obscure beacons provided to render bracket 30, and thus the fire extinguisher, conspicuous. Therefore, beacons need not be duplicated, as is the case with the embodiment of FIG. 1.

Bracket 30 has a visible beacon 42, which may be substantially identical to lighting fixture 22 of FIG. 1, and therefore will not be described further. Bracket 30 also has an audible beacon in the form of buzzer or chime 44. Chime 44 has a battery and switch (neither shown), but differs from lighting fixture 22 in having an integral sound generator. Both visible beacon 42 and chime 44 are provided so that in the event of a fire, location of the fire extinguisher will be apparent to all occupants, sighted or blind, and with or without ambient lighting being present in the structure having bracket 30.

Figure 3:
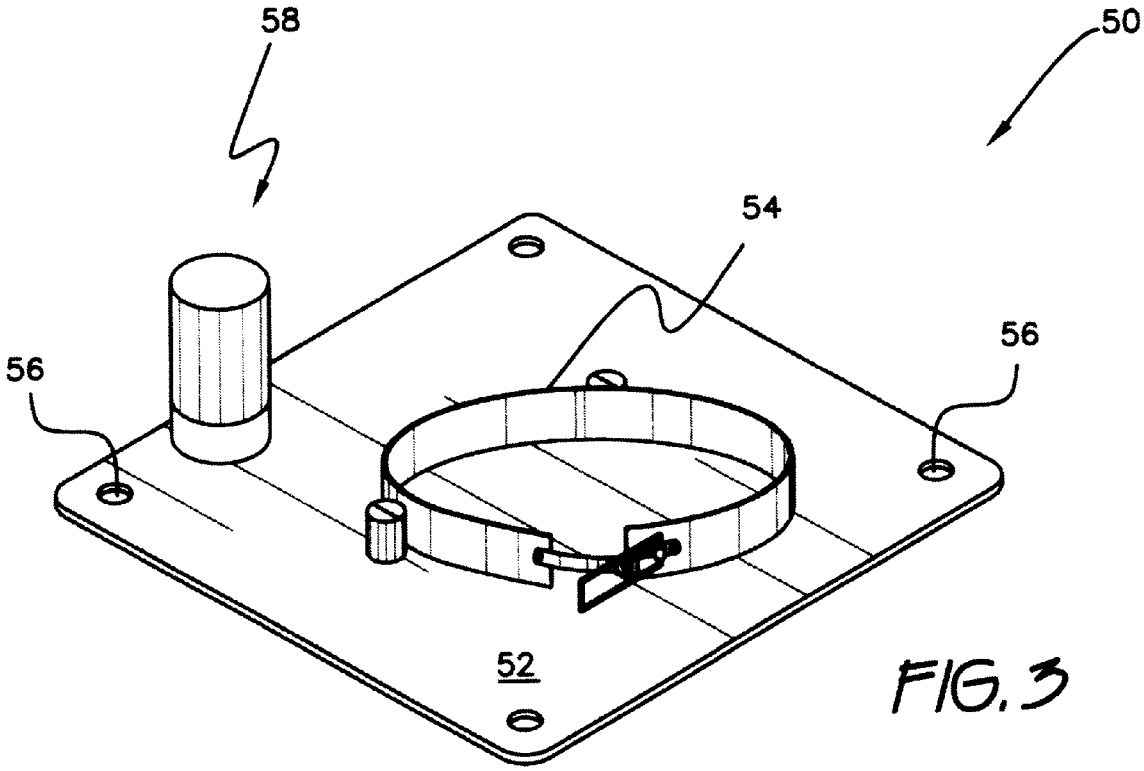
FIG. 3 is a perspective view of a third embodiment of the invention.

Referring now to FIG. 3, bracket 50 supports a fire extinguisher in an upright orientation in a manner similar to those of brackets 10 and 30. However, bracket 50 is adapted to be mounted on a horizontal surface such as a countertop, floor, or upper surface of a table. Bracket 50 includes a base plate 52, a band 54 for securing the fire extinguisher, and holes 56 for accepting fasteners. Band 54 is fixed to base plate 52 so that the fire extinguisher will be vertically oriented when base plate 52 occupies a horizontal plane. A lighting fixture 58 is mounted to base plate 52, and serves as a source of visible light. Lighting fixture 58 has battery, switch, and lamp which are essentially similar to those of lighting fixture 22 of FIG. 1. However, lighting fixture 58 is configured and located to be visible even when a fire extinguisher is in place, supported by bracket 50.

Figure 4:
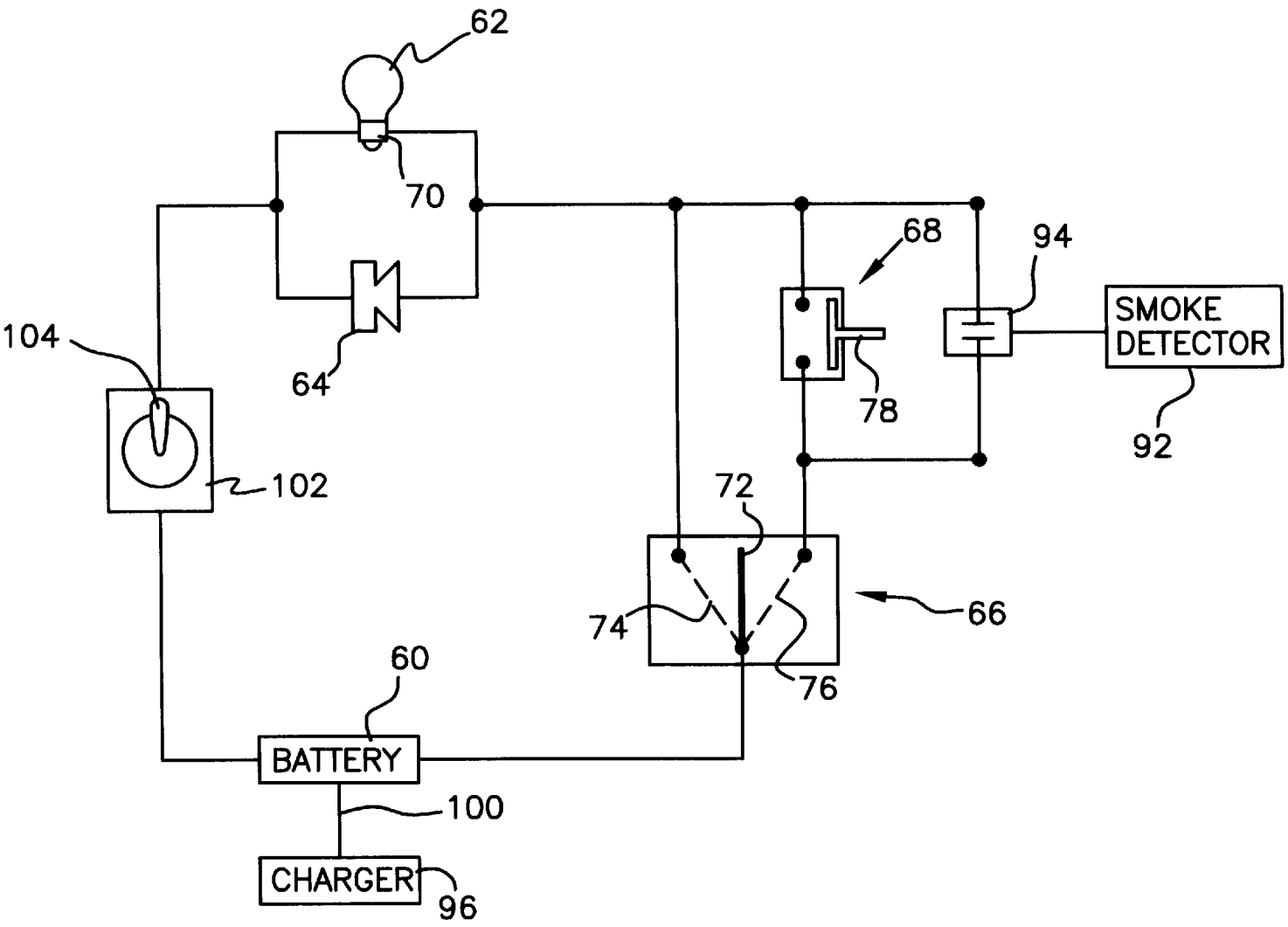
FIG. 4 is an electrical schematic of the power circuit of a further embodiment of the invention.

FIG. 4 illustrates an electrical power circuit serving beacons provided for a bracket provided with one or more beacons. The circuit includes a battery 60, a visible beacon 62, and audible beacon 64, a manual switch 66, and an automatic switch 68. Visible beacon 62 is any suitable lighting fixture. Optionally, beacon 62 includes a flasher 70. Flasher 70 is any suitable device for periodically interrupting power to beacon 62, with the result that beacon 62 flashes or illuminates intermittently. If desired, audible beacon 64, which may be any suitable buzzer or chime, may also be provided with a device interrupting power periodically so that beacon 64 operates intermittently.

A battery charger 96 is provided so that battery 60 may constantly be charged from external power, such as a building power circuit (not shown). Terminals 98 (see FIG. 1) are provided to enable ready connection to the building electrical supply. Should the usual power fail, battery 60 will operate the electrical components of bracket 10 without interruption. Charger 96 is fixed to base plate 16 in any suitable location. A suitable conductor 100 connects charger 96 to battery 60. Of course, terminals 98 will be covered suitably to prevent injury, short circuits and ground faults, and other electrical hazards.

Switch 66 provides three switching conditions affording control over the mode of operation of beacons 62, 64. In one condition, that corresponding to a position of a dial or operating lever shown at 72, power to beacons 62, 64 is disconnected from battery 60. A representative operating lever is shown in solid lines in position 72 in the depiction of FIG. 4.

The operating lever may also be moved to a second position indicated in broken lines at 74. In this position, the switch will connect power from battery 60 to beacons 62, 64, so that beacons 62, 64 are operating. In the third condition, indicated in broken lines at 76, power is connected to beacons 62, 64 through automatic switch 68. Beacons 62, 64 thus operate responsively to a condition actuating switch 68.

Automatic switch 68 responds to a condition which a user may wish to monitor in order to cause beacons 62, 64 to operate. In the example of FIG. 4, switch 68 is a proximity switch having a plunger 78. Switch 68 is physically located in an appropriate place on a bracket 10, 30, or 50 so that placement of a fire extinguisher in the intended position for storage causes the fire extinguisher to contact and deflect plunger 78. Deflection of plunger 78 closes the circuit, and beacons 62, 64 operate. Therefore, operation of beacons 62, 64 is limited to times when a fire extinguisher is actually placed in and supported by bracket 10, 30, or 50. At other times, power of battery 60 is conserved. Also, no sound or light are generated which could potentially distract persons present and engaged in various activities.

Beacons 62, 64 are preferably activated responsive to a smoke detector 92. Smoke detector 92, which may be mounted on base plate 16, as shown in FIG. 1, operates a controller, such as relay 94, connected by the circuitry to close a power circuit and conduct electrical power to beacons 62, 64 responsive to smoke detector 92 detecting smoke. Relay 94 is of course operably connected to power from battery 60. Smoke detector 92 may be located remotely from bracket 10 if desired.

A timer 102 is disposed within the circuit such that it selectively opens and closes the power circuit to beacons 62 and 64. Timer 102 is of any conventional type which has a manual control, indicated by dial 104, for selectively controlling a period of time starting at a predetermined time of day during which beacons 62, 64 are operably connected to power, subject of course to the other control features.

The safety systems of bracket 10 may optionally be interlocked with a building sprinkler system (not shown). Illustratively, relay 94 may have additional contacts (not shown) arranged to send a signal when closed to the controller of the building sprinkler system such that the building zone including bracket 10 is subjected to sprinkler operation.

Figure 5:
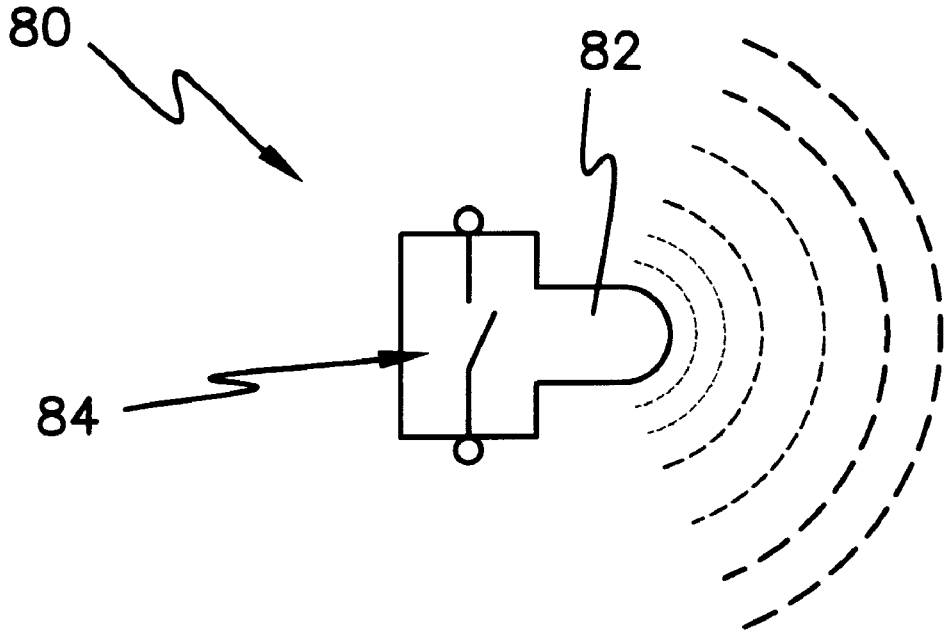
FIG. 5 is a diagrammatic detail view of an alternative form of a switch employed in the circuit of FIG. 4.

Other conditions may be monitored to effect operation of beacons 62, 64. As seen in FIG. 5, an automatic switch 80 comprises a motion detector 82. Motion detector 82 has associated contacts 84 closing a circuit when motion is detected. In a building, it is a reasonable assumption that people are frequently moving, and that human presence may be inferred by detection of motion. This arrangement assures that beacons 62, 64 are operative when persons are present, and that battery power is conserved when no occupants are present.

Other arrangements of brackets 10, 30, and 50, and associated power circuits are possible. More than one type of automatic switch may be provided. For example, an additional automatic switch incorporating a light detector may be employed to operate beacon 62 when ambient light falls below a predetermined threshold.

An automatic switch may be bypassed in connecting a beacon 62 or 64. For example, audible beacon 64 may be arranged to operate regardless of detection of light. The number, nature, and location of beacons may be varied to suit preferences. Control of beacons may also be varied.

Thus there has been described a bracket primarily although not necessarily devoted to a fire extinguisher, the bracket being improved by beacons signaling the location of the bracket and hence of a fire extinguisher. The bracket is distinguished from other supports by the characteristic that it includes structure for supporting an elongated object in a substantially fixed position relative to the bracket by partial encirclement or surrounding. If the band or equivalent structure for engaging the object is elastic or deformable, some incidental movement of the object may occur.

This structure is unlike a support structure such as a cabinet having shelves, which do not engage secured objects by partial encirclement or surrounding, and thus do not secure their supported objects in a substantially fixed position. Also, a bracket secures its subject object in a location substantially centered relative to the bracket. If the bracket is modified to support plural objects, then the plural objects, when all are present and supported, will collectively be centered relative to the bracket.

It is to be understood that the present invention is not limited to the embodiments described above, but encompasses any and all embodiments within the scope of the following claims.

I claim:

1. A bracket for holding fire safety articles in a location accessible to persons in a building, having:

first support apparatus disposed to at least partially encircle and thereby support an elongated object in a constant orientation;

second support apparatus of dimensions and configuration different from those of said first support apparatus, wherein said second support apparatus is disposed to at least partially encircle and thereby support a fire safety related article on said bracket;

mounting apparatus for mounting said bracket to an environmental surface in a fixed location;

a beacon fixed to said bracket, for rendering said bracket conspicuous;

a battery for powering said beacon; and circuitry for operably connecting said battery to said beacon, said circuitry including a proximity switch arranged to close said circuitry and cause said beacon to render said bracket conspicuous when an elongate object is placed in and supported by said bracket.

2. The bracket according to claim 1, wherein said circuitry includes a controller disposed to receive a signal from a smoke detector and to close said circuitry to conduct electrical power to said beacon, thereby causing said beacon to render said bracket conspicuous responsive to the smoke detector detecting smoke.

3. The bracket according to claim 2, further including a smoke detector fixed to said bracket, wherein said circuitry includes a conductor disposed to receive a signal from said smoke detector and conduct said signal to said controller.

4. The bracket according to claim 1, further comprising a battery charger fixed to said bracket and operably connected to said battery by said circuitry, thereby enabling constant recharging of said battery when said battery charger is connected to external electrical power.

5. The bracket according to claim 1, wherein said bracket has an exposed surface and indicia disposed on said exposed surface, and said indicia is in a form recognizable by touch.

6. The bracket according to claim 1, wherein said circuitry includes a timer disposed selectively to open and close a power circuit to said beacon at predetermined times of day.

7. A bracket for holding fire safety articles in a location accessible to persons in a building, having:

first support apparatus disposed to at least partially encircle and thereby support an elongated object in a constant orientation;

mounting apparatus for mounting said bracket to an environmental surface in a fixed location;

a beacon fixed to said bracket, for rendering said bracket conspicuous, said beacon comprising a source of visible light;

a battery for powering said beacon;

circuitry for operably connecting said battery to said beacon, said circuitry including a proximity switch arranged to close said circuitry and cause said beacon to emit visible light when an elongate object is placed in and supported by said bracket, and a timer disposed selectively to open and close a power circuit to said beacon at predetermined times of day; and a battery charger fixed to said bracket and operably connected to said battery by said circuitry, thereby enabling constant recharging of said battery when said battery charger is connected to external electrical power.

8. The bracket according to claim 7, wherein said circuitry includes a controller disposed to receive a signal from a smoke detector and to close said circuitry to conduct electrical power to said beacon, thereby causing said beacon to emit visible light responsive to the smoke detector detecting smoke.

9. The bracket according to claim 8, further including a smoke detector fixed to said bracket, wherein said circuitry includes a conductor disposed to receive a signal from said smoke detector and conduct said signal to said controller.

10. The bracket according to claim 7, wherein said bracket has an exposed surface and indicia disposed on said exposed surface, and said indicia is in a form recognizable by touch.

11. A bracket for holding fire safety articles in a location accessible to persons in a building, having:

first support apparatus disposed to at least partially encircle and thereby support an elongated object in a constant orientation;

mounting apparatus for mounting said bracket to an environmental surface in a fixed location;

a beacon fixed to said bracket, for rendering said bracket conspicuous;

a battery for powering said beacon;

circuitry for operably connecting said battery to said beacon, said circuitry including a proximity switch arranged to close said circuitry and cause said beacon to emit visible light when an elongate object is placed in and supported by said bracket; and a smoke detector operably connected to said circuitry to activate said beacon responsive to detecting smoke.

12. The bracket according to claim 11, wherein said bracket has an exposed surface and indicia disposed on said exposed surface, and said indicia is in a form recognizable by touch.

13. The bracket according to claim 11, wherein said beacon comprises a sound generating device.

14. The bracket according to claim 11, further including second support apparatus of dimensions and configuration different from those of said first support apparatus, wherein said second support apparatus is disposed to at least partially encircle and thereby support a fire safety related article on said bracket.